United States Patent [19]

Robinson

[11] 4,023,760

[45] May 17, 1977

[54] SWIVEL CHAIR

[76] Inventor: Gerard A. Robinson, 1928 Galerita Drive, San Pedro, Calif. 90732

[22] Filed: Dec. 22, 1975

[21] Appl. No.: 643,407

[52] U.S. Cl. ..... 248/188.2; 248/416

[51] Int. Cl.[2] ..... F16M 11/24

[58] Field of Search ..... 248/188.2, 188.3, 188.6, 248/412, 415, 425, 416, 398, 158, 161; 297/325, 349

[56] References Cited

UNITED STATES PATENTS

| | | | |
|---|---|---|---|
| 911,893 | 2/1909 | Massey | 248/415 |
| 2,682,131 | 6/1954 | Matter | 248/188.3 |
| 2,695,147 | 11/1954 | Castricone | 248/188.3 |
| 3,021,638 | 2/1962 | Kristek | 248/188.2 |
| 3,727,873 | 4/1973 | Hill | 297/349 |
| 3,819,136 | 6/1974 | Finke | 248/188.2 |

FOREIGN PATENTS OR APPLICATIONS

| | | | |
|---|---|---|---|
| 637,702 | 7/1962 | Italy | 297/349 |

*Primary Examiner*—Robert A. Hafer
*Attorney, Agent, or Firm*—Edward C. Walsh

[57] ABSTRACT

A swivel chair of the type embodying a support platform or pedestal with an upright and with jointed or articulated arms carried by the upright with the chair rotatably supported at the end of one of the arms. The chair can swivel or swing through 360° around the axis of the upright. If the floor on which the support platform rests is not level the axis of the upright is not vertical and the chair tends to swing by gravity to the lowermost position. The invention embodies an improvement to compensate for floor that is not level. The upright embodies a spindle and tilt ring having complementary inclined surfaces. By relative rotation of these elements the spindle can be brought into a vertical position and fixed at that position. The spindle is secured to a base member by a special nut having a convex surface cooperating with a complementary concave surface held within the base member.

9 Claims, 3 Drawing Figures

SWIVEL CHAIR

BACKGROUND OF THE INVENTION

1. Field of the Invention

The field of the invention is that of swivel chairs, particularly of that type referred to in the abstract. These are chairs of a type as stated that can be swung or swivelled around the center through 360° as described. The particular improvement is that referred to in the abstract of providing means in the mounting to compensate for placement of the chair on a floor that is not level.

2. Description of the Prior Art

Reference is made to U.S. Pat. No. 1,484,229 and U.S. Pat. No. 3,186,761. These patents disclose known chair constructions. U.S. Pat. No. 3,186,761 illustrates one attempt to compensate for placement of the platform or supporting means for the chair on a floor or surface that is not level. Herein invention provides novel and improved means in chairs of the type shown, and as described in detail hereinafter for bringing the support spindle into a vertical position and holding it there even though the floor on which the chair is placed is not level.

SUMMARY OF THE INVENTION

The basic construction of the invention is identified in the abstract. A support base for the chair is provided which may be circular. At the center of the base is a fitting having a bore and a counterbore, the upper end of the counterbore forming a concave surface. Supported on the base fitting is a spindle which carries one of the support arms of the chair, the arm being journalled on the spindle by ball bearings. The bottom of the spindle has a slanted surface and between this surface and the base fitting is a tilt member having a complementary slanting surface. The spindle and tilt ring are relatively rotatable, the slanted surfaces cooperating with each other such that the spindle can be brought from a position out of vertical into exact plumb or vertical. A bolt extends down through the bore in the spindle and it engages a special nut with a convex end surface which cooperates with the concave surface in the base fitting so that the spindle is fixed to, or accurately held with respect to the base fitting with the spindle in a vertical position.

In the light of the foregoing the primary object of the invention is to provide an improved, simplified, and more effective means or mechanism for use in a swivel chair to compensate for placement of the chair on a floor or surface that is not level so that the chair will remain in any angular position to which it may be adjusted.

A further object is to provide a mechanism as in the foregoing object wherein the desired result is achieved by way of a spindle having a slanting surface cooperating with a relatively adjustable tilt ring whereby the spindle can be brought into a vertical position with holding means comprising a bolt extending through the spindle and held by a special nut having a convex part cooperating with concave surface.

Further objects and additional advantages of the invention will become apparent from the following detailed description and annexed drawings.

BRIEF DESCRIPTION OF THE DRAWINGS

Referring now more in detail to the various figures of the drawings, FIG. 1 shows a chair which includes a seat component 10 of the shape shown. The seat may be formed in various ways known in the prior art such as being fabricated from plastic or otherwise. The support surface or floor is indicated at 12. The chair is supported from a circular base or pedestal as designated at 14, the upper part of which is cone shaped as shown. Numeral 20 designates a first arm, the inner end of which is rotatably and horizontally mounted on an upright extending upwardly from the base 14 as will be described. The outer end of the arm 20 is pivotally connected to another horizontal arm 22.

Figure 1:
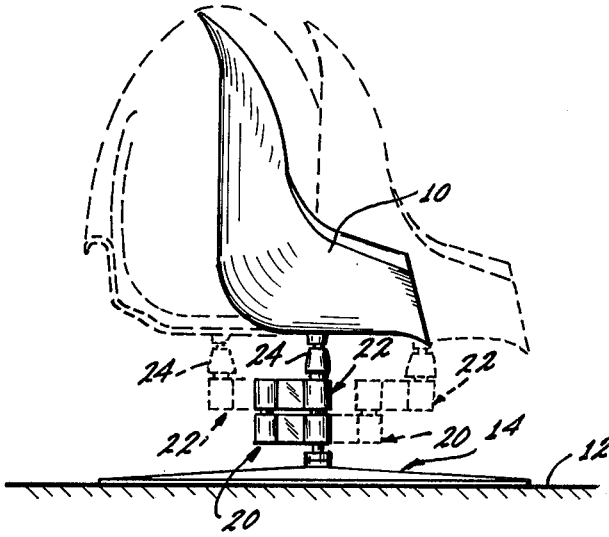
FIG. 1 is a pictorial view illustrating a preferred form of the invention.

Extending downwardly from the chair is a stem or standard 24 which is rotatably mounted in the inner end of the arm 22. The arms 20 and 22 are of equal length so that the chair can be brought into a position directly over the center of the base 14 as shown in FIG. 1. The chair is rotatable about the axis of the standard 24 and it also can be swung or swivelled around the axis of the base 14 into positions such as those illustrated with broken lines.

Figure 2:
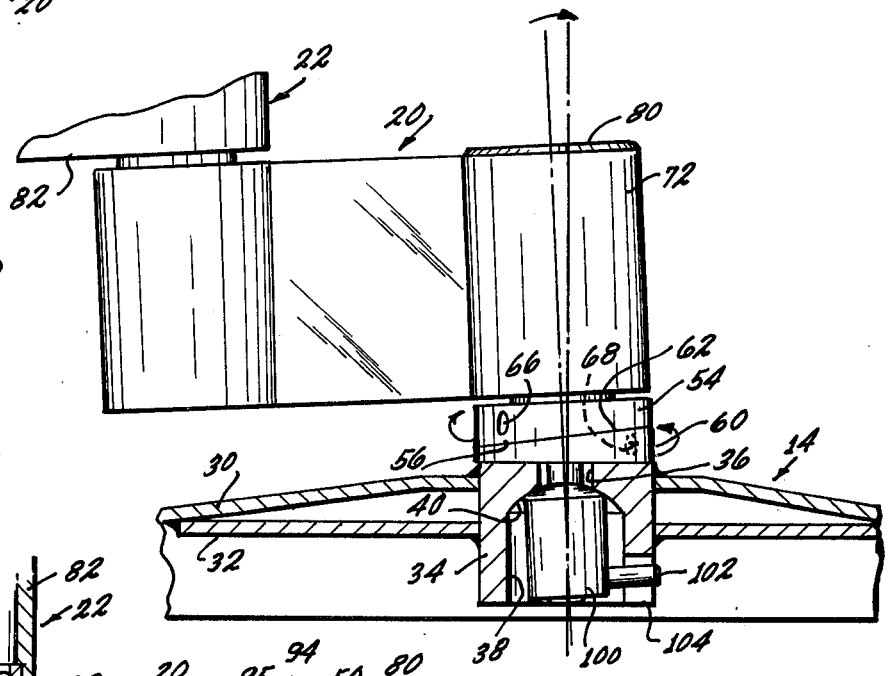
FIG. 2 is a view of the lower part of the chair showing the base and base fitting in cross section.
Figure 3:
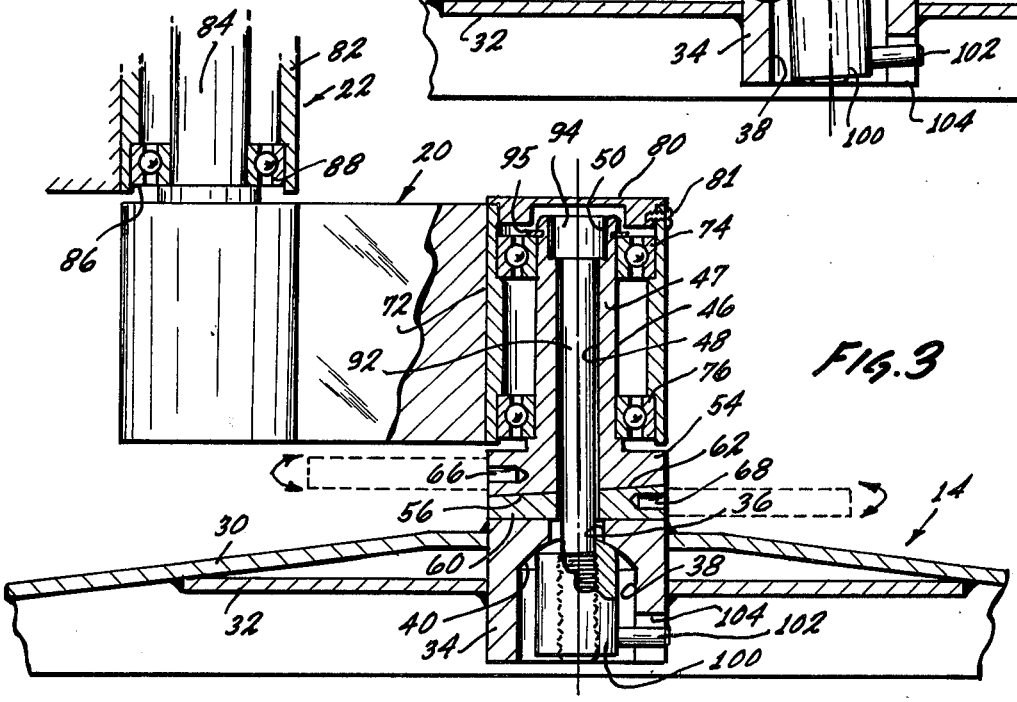
FIG. 3 is a sectional view showing the spindle and the support at the end of an arm in cross section.

FIGS. 2 and 3 show in detail the mounting of the inner end of the arm 20 from the base 14. The base 14 includes a domed or conical part or section 30 and a horizontal circular part 32 that may be secured to it by welding or otherwise. At the center of these parts is a base member or fitting 34 that fits into openings in the parts and may be welded thereto. The base fitting has a bore 36 and a larger counterbore 38. The upper end of the counterbore 38 is spherically concave as designated at 40.

Numeral 46 designates a spindle member, the upper part of which is designated at 47 and is tubular having a bore 48 and a counterbore 50 at the end. The lower end part of the spindle 46 is of larger diameter as designated at 54 and this part has a bottom slanting surface as designated at 56. Between the surface 56 and the top surface of the fitting 34 is a tilt ring 60, the bottom surface of which is flat and the upper surface of which as designated at 62 is slanted so as to be complementary to the slanting surface 56 on the spindle 46. In the part 54 of the spindle 46 is a bore 66 for receiving a tool, the tilt ring 60 having a similar bore 68. Tools as shown in broken lines can be inserted into these bores for rotating the spindle 46 and the tilt ring 60 in opposite directions, the complementary slanting surfaces cooperating with each other during these movements. As may be seen, by making these movements the spindle 46 can be brought into an exactly vertical position even though the base 14 would be resting on a surface or floor that is not perfectly level. The spindle can be fixed in the vertical position as will be described presently.

At the inner end of the arm 20 is a support bushing or fitting 72. Interposed between this support bushing and the spindle 46 are ball bearings 74 and 76 so that arm 20 is journalled to be rotatable substantially without friction on the spindle 46. The upper end of the bushing 72 is closed by a cap 80 held by set screw 81. A similar bushing 82 is provided at the outer end of the arm 22 and this arm is journalled on a pin or stem 84 by way of bearings 86 and 88. The stem 84 is supported at the outer end of the arm 20.

Numeral 92 designated the stem of a bolt which extends through the bore 48 in the spindle 46, its lower end being threaded. The bolt has a head 94 received in the counterbore 50 in the spindle 46 as shown. Truarc ring 95 secures against bearings 74 so the chair cannot be lifted off the spindle. Numeral 100 designates a special nut that threads onto the threaded end of the bolt 92. Its upper end is of convex configuration to be complementary to the concave surface 40 at the upper end of the counterbore 38. Extending from the side of the nut 100 is a pin 102, the pin extending through an arcuate slot in the side of the fitting 34, to hold the nut from turning.

From the foregoing those skilled in the art will readily understand the utilization and operation of the invention. If the support platform 14 is placed on a surface or floor that is not level, the spindle 46 can nevertheless be brought into an accurate vertical position. Tools are merely inserted into the bores 66 and 68 and the spindle 46 and the tilt ring 60 are turned relatively in opposite directions with the slanting surfaces 56 and 62 cooperating until the spindle 46 is in an exact vertical position. When doing this the bolt 94 is loosened to allow the parts to move relatively by turning bolt 92, head 94 having an Allen socket. The spindle 46 is capable of moving from a position out of vertical into a vertical position moving the bolt 92 with it because the convex surface on the nut 100 can move relatively with respect to the concave surface 40 inside of the fitting 34. When the spindle 46 is vertical, the bolt 92 is tightened in the nut 100 by means of an Allen wrench so the spindle 46 is securely held in the exact vertical position. In this position, as may be seen, the chair then can be readily swung or swivelled into any angular position through 360 degrees. Because of the spindle 46 being vertical the chair will not tend to swing by gravity as would be the case if the spindle were not vertical.

When vertical adjustment of the spindle has been made, preferably an aligning marker or line is provided on the base to orient with respect to a desk with any unevenness in the floor accommodated.

From the foregoing those skilled in the art will readily appreciate the manner in which all of the objectives and advantages of the invention are realized.

The foregoing disclosure is representative of a preferred form of the invention and is to be interpreted in an illustrative rather than a limiting sense the invention to be accorded the full scope of the claims appended hereto.

What is claimed is:

1. A movable chair comprising a base adapted for placing on a surface, upright means having an axis centrally carried by the base, jointed arm means carried by the upright means and a chair carried by the arm means, the arm means including first and second arms extending perpendicular to said upright means and pivoted together at a point spaced from said axis so that they are each movable in planes parallel to each other, the upright means including a spindle, the arm means being mounted to be rotatable about the spindle, and adjusting means providing a relationship between said spindle and the base means whereby relative rotation of the spindle changes its position whereby it may be adjusted to an exact vertical position, and means for holding said spindle in vertical position with respect to the base.

2. A chair as in claim 1, wherein the adjusting means includes juxtaposed surfaces, at least one of which is a slanting surface whereby upon relative rotation between the said surfaces the angle of the spindle with respect to vertical can be changed.

3. A chair as in claim 2, wherein said adjusting means includes a tilt ring having a slanting surface positioned between the spindle and the base means.

4. A chair as in claim 3, wherein said spindle and the tilt ring have complementary slanting surfaces juxtaposed against each other.

5. A chair as in claim 2, including a holding bolt extending through a bore in the spindle, a holding nut engageable with the end of the bolt of said holding bolt and said base means and holding nut having complementary surfaces permitting the spindle and holding bolt to be moved angularly with respect to the said base fitting.

6. A chair as in claim 5, wherein said base means includes a fitting having an opening in which is received the holding nut, one of said complementary surfaces being formed in said opening.

7. A chair as in claim 6, wherein said complementary surfaces include a convex surface formed on said holding nut which is engageable with the concave surface formed within said opening.

8. A chair as in claim 4, wherein the said spindle and tilt ring are provided with means to receive tools for manually rotating the spindle and tilt ring in opposite directions.

9. A chair as in claim 7, including a handle member on said holding nut to keep nut from turning when loosening bolt.

* * * * *